United States Patent [19]

Hawkins

[11] 4,293,286

[45] Oct. 6, 1981

[54] DOUBLE ACTION PUMP

[76] Inventor: Joel W. Hawkins, Rte. 2, Marietta, S.C. 29661

[21] Appl. No.: 5,224

[22] Filed: Jan. 22, 1979

[51] Int. Cl.[3] ..... F04B 3/00

[52] U.S. Cl. ..... 417/253; 417/397; 91/290; 100/251

[58] Field of Search ..... 417/252–253, 417/267, 397; 91/290; 100/237, 244, 251

[56] References Cited

U.S. PATENT DOCUMENTS

| | | | |
|---|---|---|---|
| 18,225 | 9/1857 | Ruberts | 91/290 |
| 2,422,895 | 6/1947 | Habenicht | 100/251 X |
| 2,820,415 | 1/1958 | Born | 417/252 X |
| 2,938,465 | 5/1960 | McFarland et al. | 417/252 |
| 2,946,287 | 7/1960 | Bessiere | 417/253 X |
| 2,948,222 | 8/1960 | Pine | 417/253 |
| 3,776,665 | 12/1973 | Dalton | 417/397 X |

*Primary Examiner*—Robert W. Jenkins
*Assistant Examiner*—Arthur O. Henderson
*Attorney, Agent, or Firm*—Bailey, Dority & Flint

[57] ABSTRACT

A two-stage pump is illustrated of the type employing a piston having two diameters, one capable of providing a large volume of fluid flow at low pressure so as to move a fluid operated press rapidly until a load is encountered, at which time fluid is delivered at a low volume at high pressure for operation of the press wherein the flow control means are positioned in a piston housing independent of the piston.

3 Claims, 6 Drawing Figures

Fig. 3.
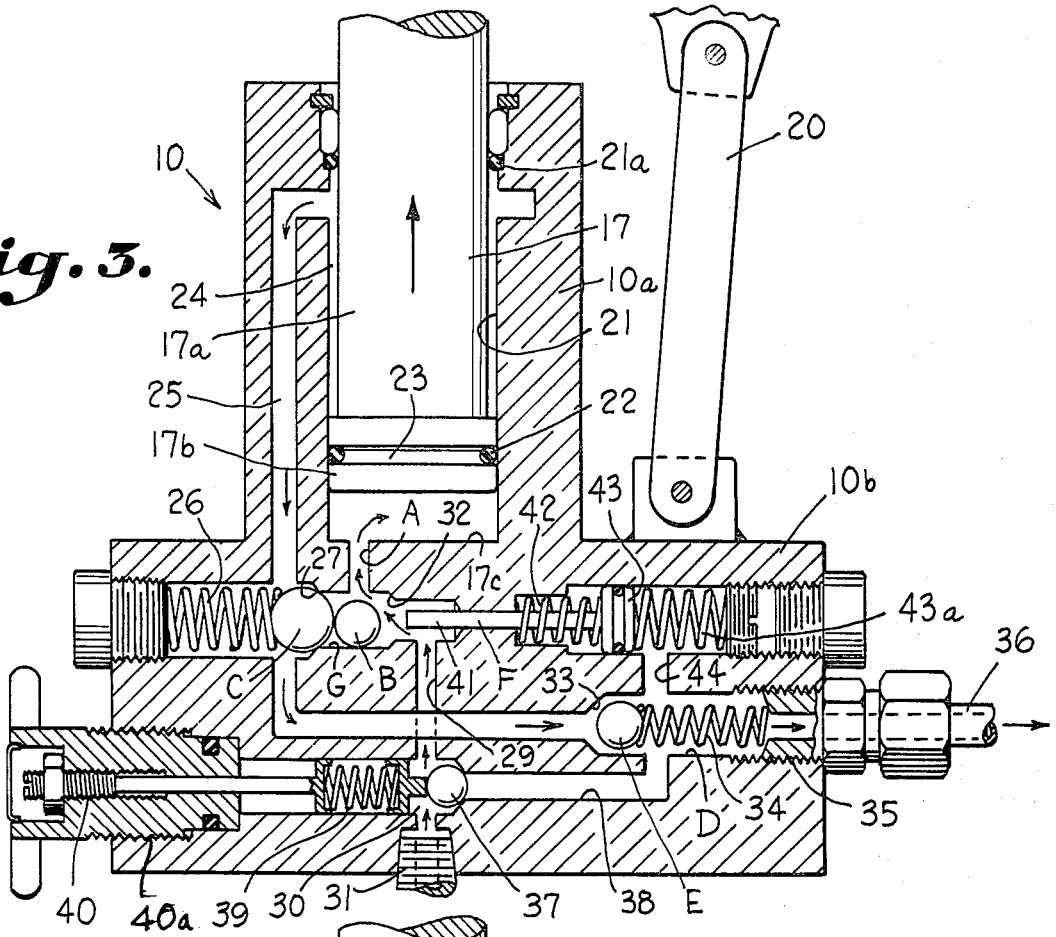
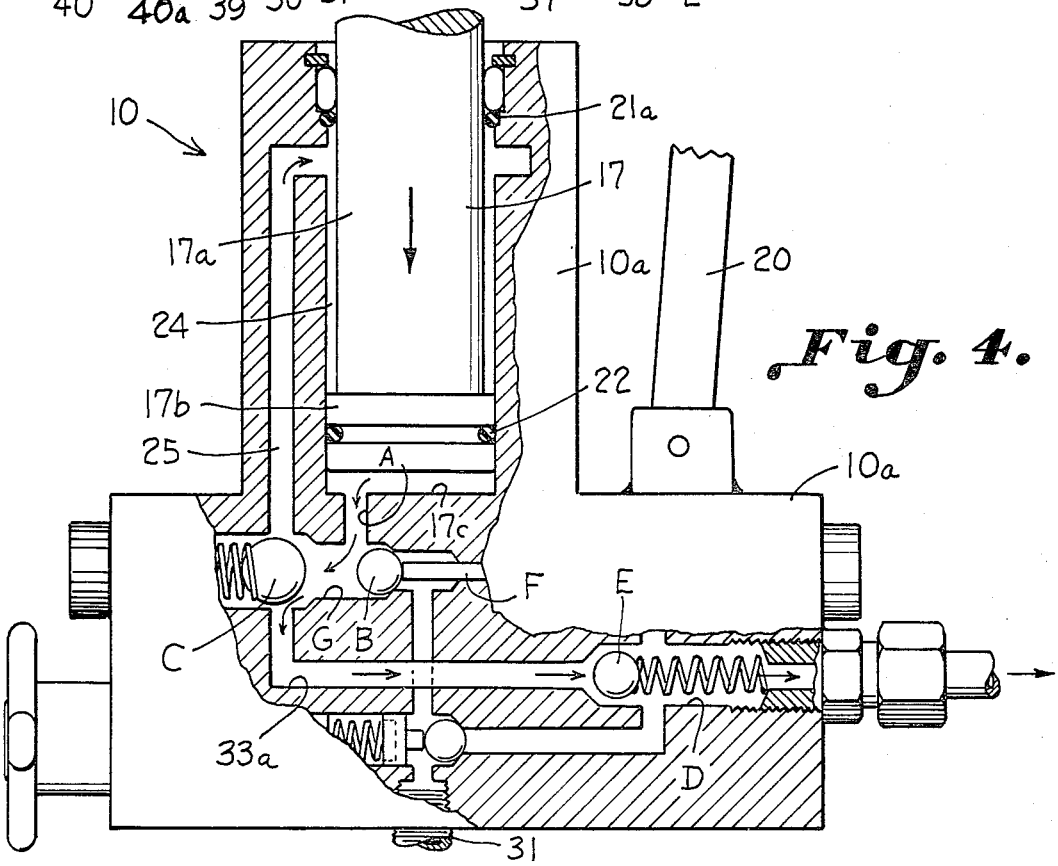
Fig. 4.

DOUBLE ACTION PUMP

BACKGROUND OF THE INVENTION

The pump of the present invention is especially useful for operating a movable ram of a press of the general type illustrated in U.S. Pat. No. 3,283,699. A pump of the two-stage hydraulic type with which the present invention is concerned is illustrated in U.S. Pat. No. 2,948,222 and is designated as being especially useful in connection with hydraulic jacks. The pump of the latter patent is difficult to construct and maintain in that the piston is ported and carries a check valve. It is also necessary to construct a cavity for receiving an unloading valve as well as other check valves for operating the two-stage system.

Accordingly, it is an important object of the present invention to provide a two-stage pump structure wherein the check valves and duct means may be confined to the housing permitting a simple cylinder arrangement having two diameters without internal valving.

It is a further object of the invention to provide a simple valving system for a two-stage pump having a manually operated piston of two diameters.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is an enlarged transverse longitudinal sectional elevation taken on the line 3—3 in FIG. 1 illustrating the valving on a high volume, low pressure intake, FIG. 4 is a sectional elevation similar to FIG. 3 illustrating the valving on a high volume low pressure stroke.

DESCRIPTION OF A PREFERRED EMBODIMENT

The drawings illustrate a pump having a housing carrying a cylinder with a manually operable piston having a large diameter and a small diameter delivering a large volume of fluid flow at low pressure when operated in one direction and a lesser volume of fluid flow at high pressure when operated in the other direction. An inlet duct A (FIGS. 3–6) is provided in the housing opposite the large piston diameter. A first check valve B is carried in the housing checking the flow of fluid outwardly through the inlet duct. A second check valve C is positioned in the housing allowing for the flow of fluid through the inlet duct. A delivery duct D in the housing communicates with the inlet duct. A third check valve E is carried in the delivery duct to check the flow of fluid from the delivery duct into the inlet duct. A fluid pressure actuated means F is related to the first check valve and operated responsive to the fluid pressure in the delivery duct to open same and render same ineffective. A bore G is provided in the housing containing the first and second check valves in opposed relation.

Figure 1:
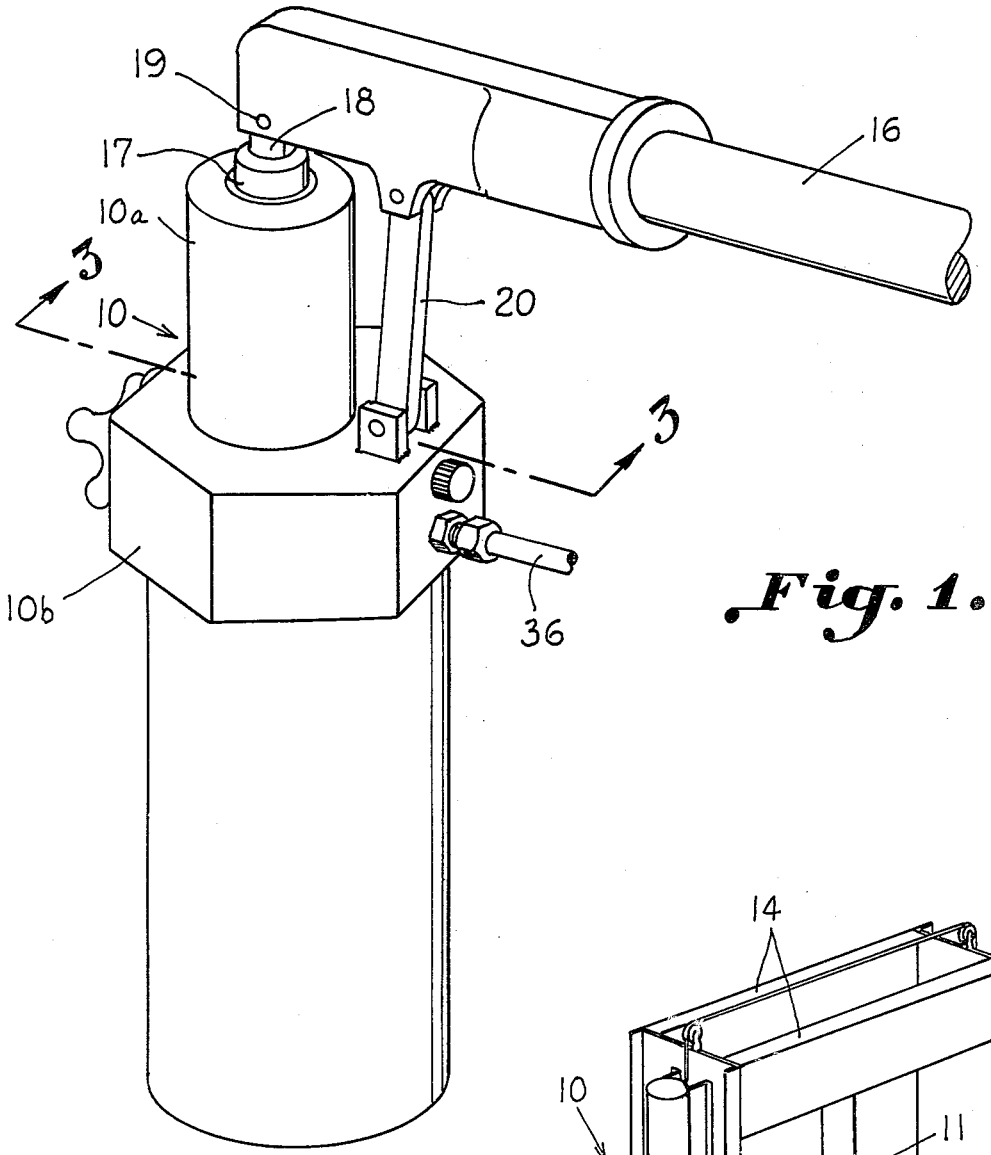
FIG. 1 is a perspective view of a pump constructed in accordance with the present invention illustrating the housing and manually operable means for operating the two diameter piston.
Figure 2:
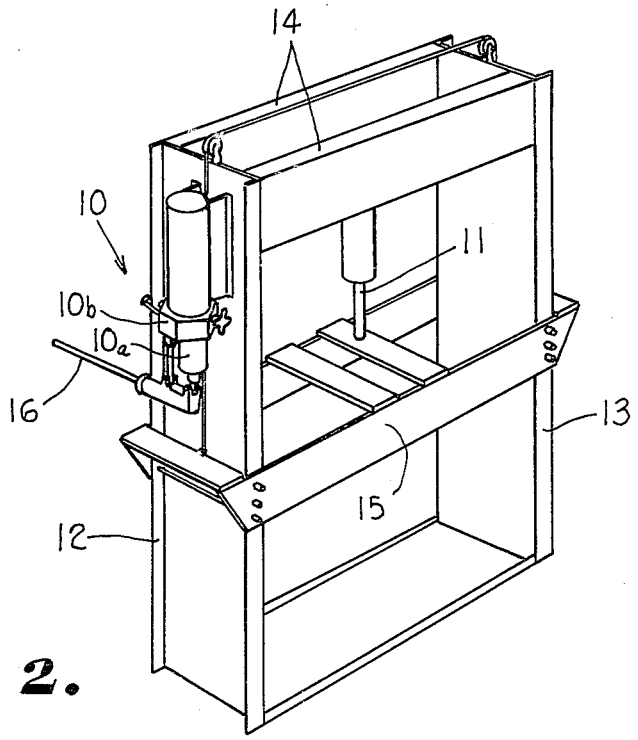
FIG. 2 is a perspective view of a press having a fluid operated ram employing a pump constructed in accordance with the present invention.

The invention relates to a pump which has a housing broadly designated at 10, FIGS. 1 and 2, illustrated as having a cylinder portion 10*a* for carrying the piston and an opposed enlarged portion 10*b* for carrying the valving and duct work comprising the particular arrangement constituting the present invention. The pump 10 is illustrated in FIG. 2 as being carried by a press to operate a hydraulic ram 11. The press has a pair of spaced vertical standards 12 and 13 bridged at the top by a suitable member 14 for carrying the ram and supporting a bed 15 for carrying the work. The pump is manually operated and has a handle 16 for operating the piston 17 through a suitable rod 18 which is pivotally connected at 19 (FIG. 1). The handle has a link 20 pivoted on one end to the handle and on the other end to the lower portion of the housing 10*b*.

The piston 17 is carried within a cylinder wall 21 within the cylinder housing portion 10*a* (FIG. 3). A suitable seal at the top of the cylinder 21 includes an O-ring 21*a* encompassing a reduced diameter portion of the piston. The piston 17 has a portion of reduced diameter 17*a* and an inner portion of enlarged diameter 17*b* opposite the base 17*c* of the cylinder opposite the piston portion having a large diameter 17*b*. The enlarged diameter portion of the piston has an O-ring 22 carried in a suitable groove 23 (FIG. 3). The portion between the reduced diameter 17*a* and the cylinder wall 21 forms a high pressure chamber 24 and a duct 25 extends therefrom to join the bore G described above, which carries the opposed check valves B and C.

It will be observed that the ball of the check valve C is biased inwardly by the spring 26 to seat as at 27. The inlet duct A communicates with the bore G and has an extension in the form of a passageway 29 which communicates with a chamber 30 which, in turn, receives a supply line 31 for fluid. The ball of the check valve B seats as at 32, while the delivery duct D carries the check valve E which seats as at 33 or within the lower portion 10*b* of the housing 10. The ball of the check valve E is biased inwardly as by the coil spring 34. The threaded member 35 forms a fitting for a line 36, extending in this case, to operate the ram 11. A release valve is illustrated as including a ball 37 which has a suitable seat within the duct 38 being maintained in position by the spring 39 which is adjustable through the threaded member 40 to supply a suitable release means in the case of excessive pressure. By backing off on the threaded portion 40*a* the pressure on the press or ram 11 is released. A fluid pressure actuated means F includes a plunger 41 which is spring biased inwardly by the coil spring 42 against an operating piston 43 which has communication through a duct 44 with the delivery duct D. The spring 43*a* urges the piston to the left in FIG. 3 against the force of the spring 42 which maintains the member 41 out of contact with the ball of the check valve B.

It will be observed by reference to FIGS. 3, 4, 5 and 6 that the pump of the present invention operates in sequence wherein FIG. 3 illustrates fluid being directed inwardly from the supply 31 through the passageway 29 and duct A into the bottom of the cylinder beneath the enlarged portion 17*b* of the piston 17. The various check valves and components described above are in position to permit such fluid flow with the piston being raised as indicated by the arrow in FIG. 3. When the piston is moved in the direction of the arrow in FIG. 4 for low pressure operation, the fluid flows through the line 33*a* opening the ball of the check valve E permitting fluid at low pressure and high volume to operate the load engaging member, in this case, the ram 11.

Figure 5:
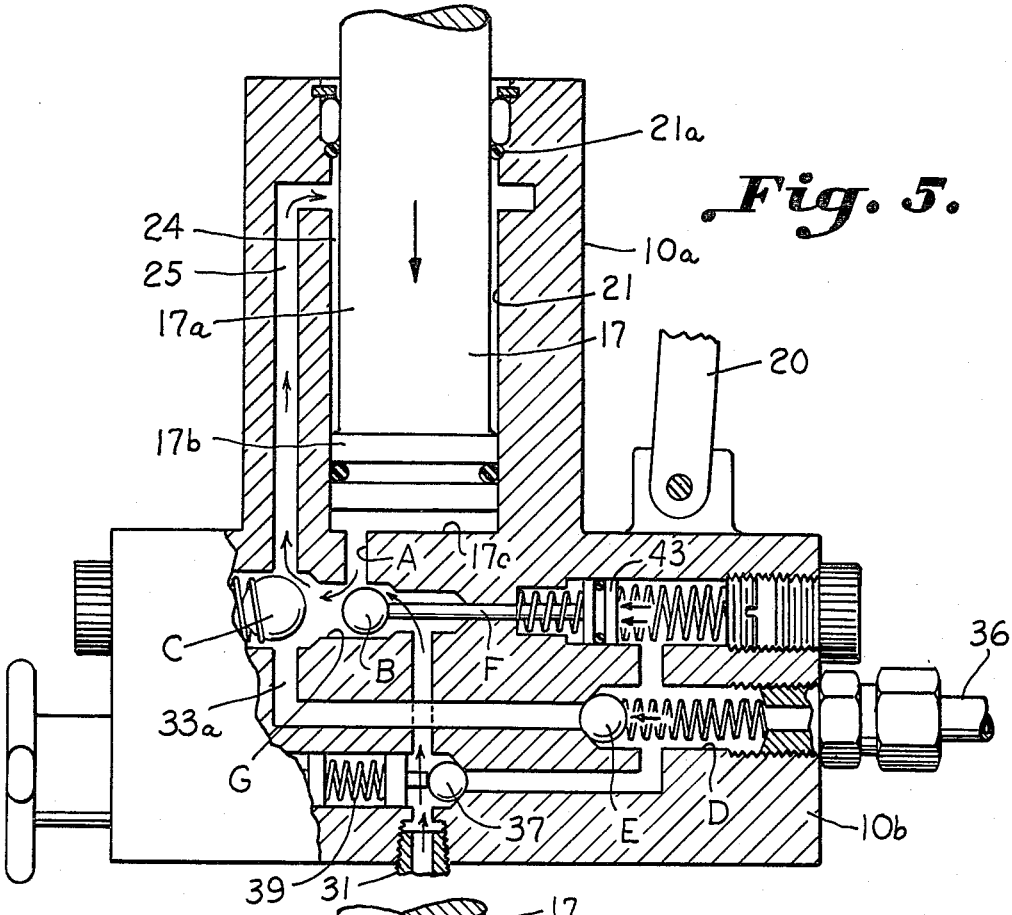
FIG. 5 is a sectional elevation similar to FIGS. 3 and 4 illustrating the valving in position for a high pressure low volume intake.

FIG. 5 illustrates the valving in position for a high pressure intake stroke with the cylinder being moved in the direction of the arrow, the ram having engaged the work or load (not shown) as may be carried by the bed 15 of the press. The fluid flows from the supply line 31 through the inlet or intake duct A from the lower portion 17*c* of the cylinder and through the supply duct 25 to the high pressure chamber 24. The fluid pressure actuated means F has moved to the left by virtue of the increased fluid pressure on the piston 43 to dislodge the ball of the check valve B to permit such flow returning excess fluid to a supply tank.

Figure 6:
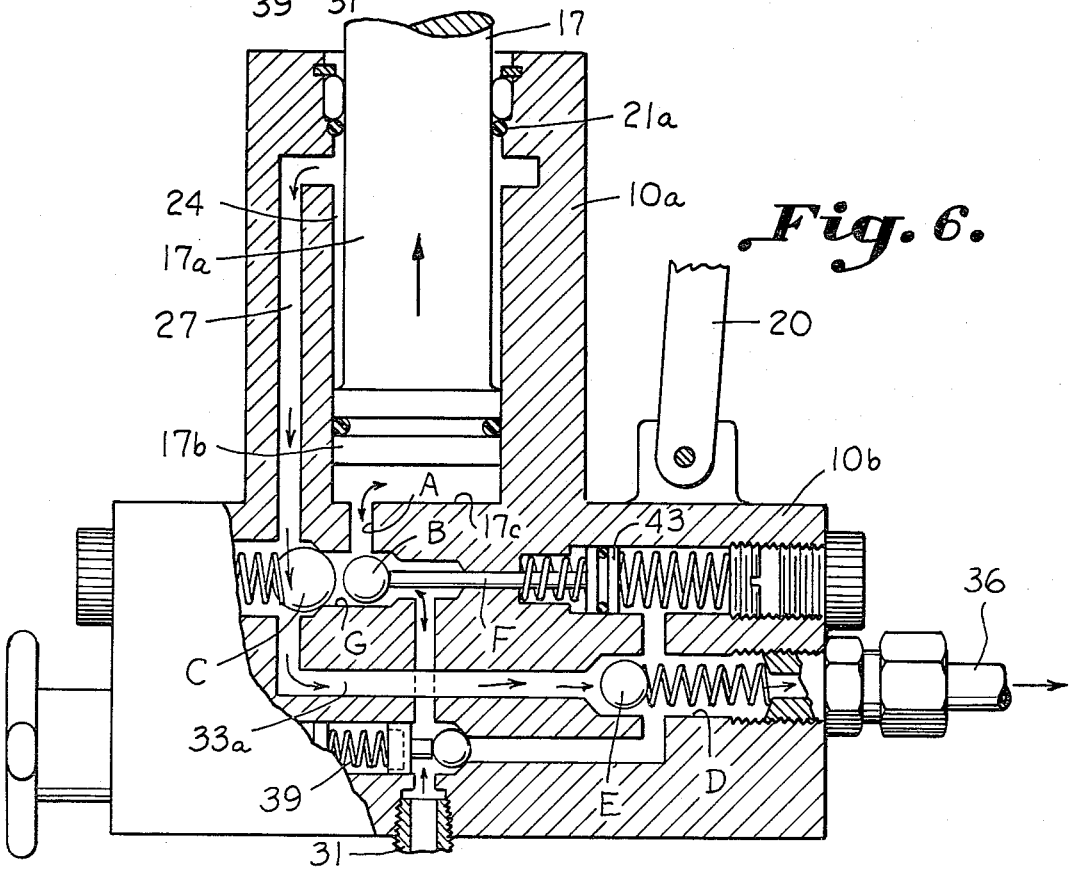
FIG. 6 is a similar sectional elevation illustrating the valving in position for a low volume high pressure stroke.

In FIG. 6, a low volume, high pressure stroke is illustrated wherein the piston, moved in the direction of the arrow with fluid flowing outwardly through the port 25 from the high pressure chamber 24, through the duct 33*a* to the delivery duct D and thence through the line 36 to operate the ram or other load engaging member. When excessive pressure is applied, adjustable pressure spring 39 releases ball check 37 returning fluid to the supply tank.

It is thus seen that an efficient two-stage pump has been provided wherein the valving and duct work are contained within a single housing which integrally contains a simple piston. Due to the simplicity and ease of the construction, the parts are easily maintained and efficiently operated in order to provide an inexpensive power source as for presses, of the type used in automotive garages. Thus, various automotive repair operations and the like are facilitated through the provision of an efficient and inexpensive press operation.

While a preferred embodiment of the invention has been described using specific terms, such description is for illustrative purposes only, and it is to be understood that changes and variations may be made without departing from the spirit or scope of the following claims.

What is claimed is:

1. A pump having a housing carrying a cylinder with a manually operable piston having a large diameter and a small diameter delivering a large volume of fluid flow at low pressure when operated in one direction and a lesser volume of fluid flow at high pressure when operated in the other direction comprising:

an inlet duct in said housing opposite said large piston diameter;

a first check valve in said housing checking the flow of fluid outwardly through said inlet duct;

a second check valve in said housing allowing for the flow of low-pressure fluid through said inlet duct for delivery through said delivery duct while checking flow of high-pressure fluid therethrough during high-pressure fluid delivery;

a delivery duct in said housing communicating with said inlet duct;

a third check valve in said delivery duct to check the flow of fluid from said delivery duct into the inlet duct; and a fluid pressure actuated plunger means operated responsive to the fluid pressure in the delivery duct to open said first check valve and render same ineffective.

2. The structure set forth in claim 1 including a bore in said housing containing said first and second check valves comprising respective balls in opposed spatial relation.

3. The structure of claim 2 wherein said ball of said first check valve is freely carried in said bore.

* * * * *